United States Patent [19]

Peters

[11] Patent Number: 4,922,600

[45] Date of Patent: May 8, 1990

[54] METHOD FOR HANGING CURTAINS

[76] Inventor: Margaret A. Peters, 1139 Summit Lawn, Wichita, Kans. 67212

[21] Appl. No.: 173,056

[22] Filed: Mar. 25, 1988

[51] Int. Cl.[5] ..... B23P 19/04

[52] U.S. Cl. ..... 29/433; 29/525.1; 160/19; 160/39; 160/405

[58] Field of Search ..... 29/433, 241, 526 R; 160/191, 381, 391

[56] References Cited

U.S. PATENT DOCUMENTS

| | | | |
|---|---|---|---|
| 1,565,734 | 12/1925 | Greenhut | 160/19 UX |
| 2,250,003 | 7/1941 | Boye | 160/39 X |
| 2,363,847 | 11/1944 | Dudas | 160/387 |
| 2,533,216 | 12/1950 | Bixer | 160/387 |
| 2,616,495 | 11/1952 | Junkunc | 160/38 |
| 3,023,909 | 3/1962 | Martens | 160/39 X |
| 3,513,902 | 5/1970 | Merillet | 29/433 X |
| 3,913,204 | 10/1975 | Finkbeiner | 29/433 X |

FOREIGN PATENT DOCUMENTS

| | | | |
|---|---|---|---|
| 342061 | 10/1921 | Fed. Rep. of Germany | 160/19 |
| 512168 | 11/1930 | Fed. Rep. of Germany | 160/38 |
| 1255291 | 1/1961 | France | 160/19 |
| 2397177 | 3/1979 | France | 160/39 |
| 163818 | 7/1958 | Sweden . | |

*Primary Examiner*—Charlie T. Moon

*Attorney, Agent, or Firm*—John W. Carpenter

[57] ABSTRACT

A window cornice assembly having a semi-circular front plate formed with an upper edge having an upper channel and a lower edge having a lower channel. A lower curtain rod is slidably disposed through the lower channel and an upper curtain rod is slidably disposed through the upper channel. A method for hanging curtains by sliding a fabric over the window cornice assembly, mounting the upper and lower curtain rods to a wall, and securing a middle curtain rod to the wall in between the upper and lower curtain rods. A curtain is hung from the middle curtain rod.

3 Claims, 4 Drawing Sheets

FIG. 7
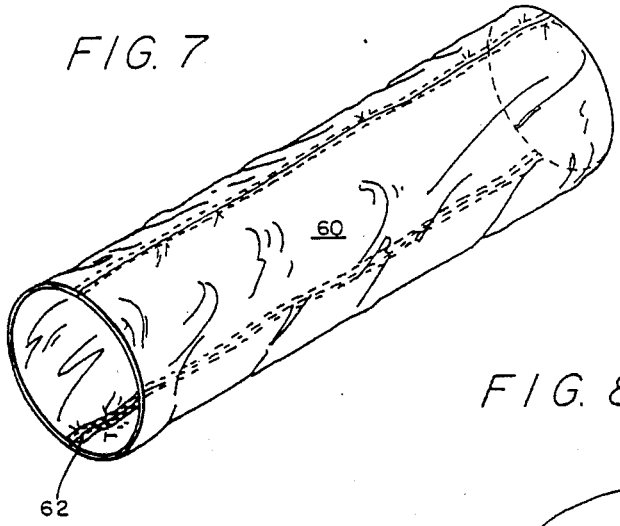
FIG. 8
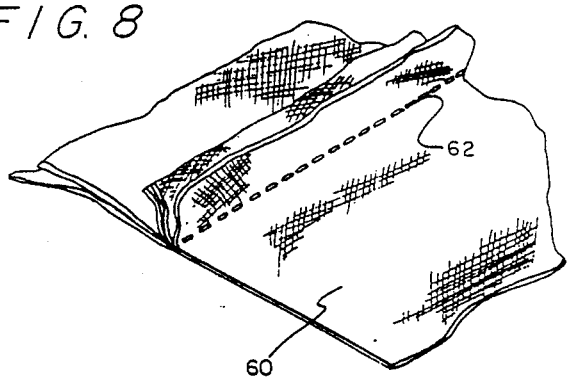
FIG. 9
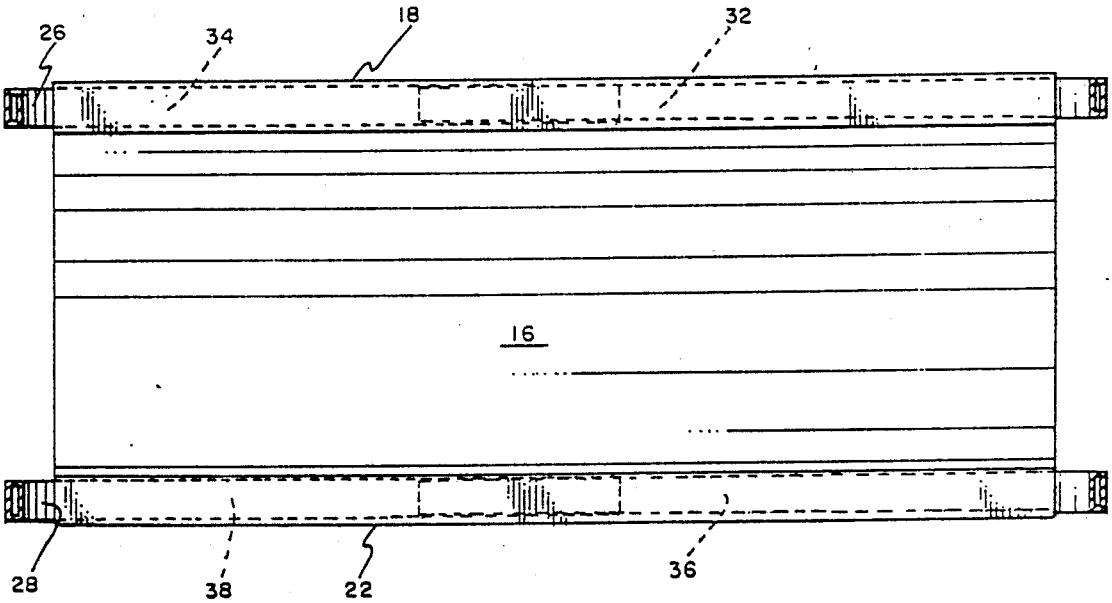
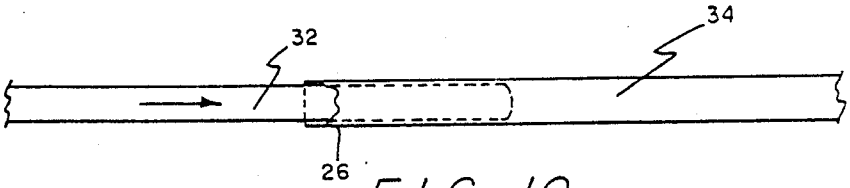
FIG. 10

FIG. 14
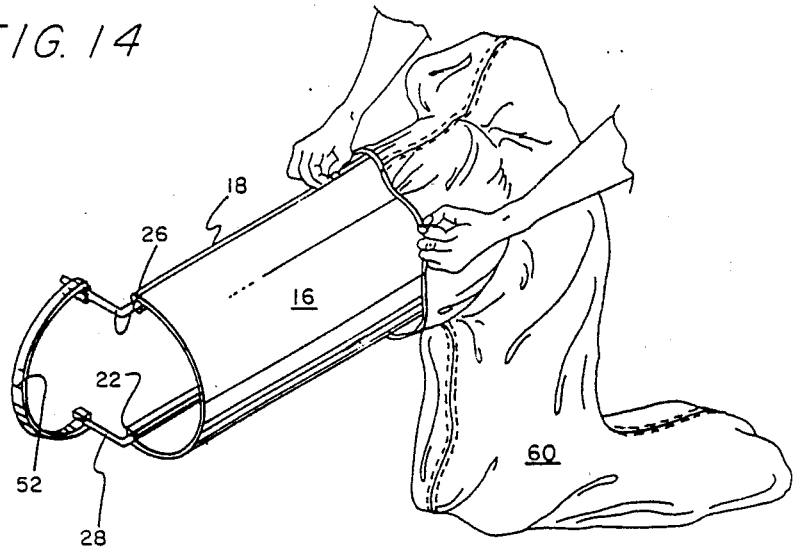
FIG. 11
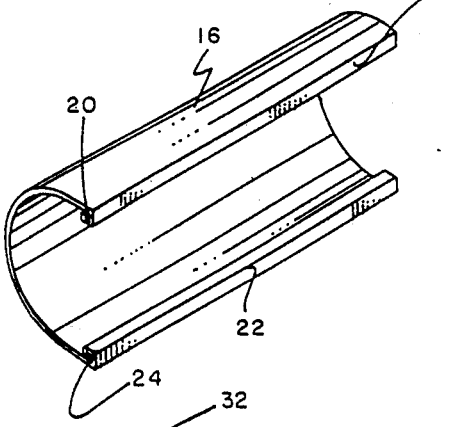
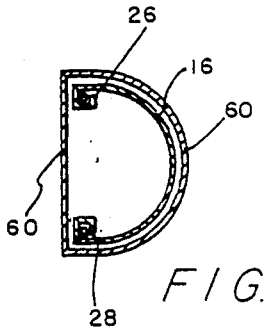
FIG. 15
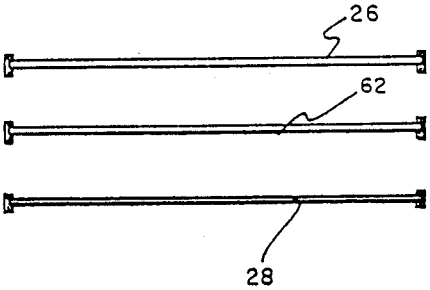
FIG. 12
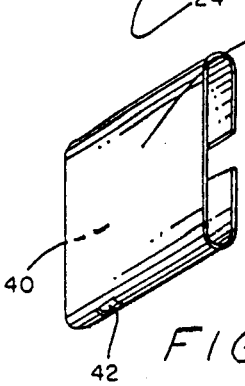
FIG. 13

METHOD FOR HANGING CURTAINS

1. FIELD OF THE INVENTION

The present invention is related generally to window cornices and the like. More particularly, the present invention relates to improvements in window cornices and to a method for hanging curtains that employs the improved window cornice of this invention.

2. DESCRIPTION OF THE PRIOR ART

A patentability investigation was conducted and the following U.S. patents were discovered: U.S. Pat. No. Des. 114,564 to Stratton; U.S. Pat. No. 2,739,644 to Brand; 2,823,743 to Isaac; 2,998,062 to Bixby; and 3,166,286 to Pfaff. None of these prior art patents teach or suggest the particular window cornice and method of this invention.

SUMMARY OF THE INVENTION

The present invention broadly accomplishes its desired objects by broadly providing a window cornice assembly that comprises a front plate member having an upper edge with an upper channel and a lower edge with a lower channel. An upper curtain rod is slidably disposed through the upper channel and a lower curtain rod is slidably disposed through the lower channel. The upper and lower curtain rods are adaptable to mount to a wall member. The window cornice assembly preferably additionally comprises a pair of side plates secured to the upper and lower curtain rods in opposed relationship with the front plate member positioned between the two side plates. A fabric encapsulates the front plate member and the two side plates.

The present invention further accomplishes its desired objects by providing a method for hanging curtains and the like comprising the steps of:

(a) forming a generally semi-circular front plate having an upper edge defining an upper channel and a lower edge defining a lower channel;

(b) forming a generally semi-circular first side plate member having a first upper edge defining a first upper channel and a first lower edge defining a first lower channel;

(c) forming a generally semi-circular second side plate member having a second upper edge defining a second upper channel and a second lower edge defining a second lower channel;

(d) sliding a first section of a first curtain rod means through the first upper channel of the semi-circular first side plate and into the upper channel of the semi-circular front plate;

(e) sliding a second section of the first curtain rod means through the second upper channel of the semi-circular second side plate and into the upper channel of the semi-circular front plate;

(f) continuing to slide the first section and the second section of the first curtain rod means while in the upper channel of the semi-circular front plate until the first section slides into the second section such that the first section is slidably disposed within said second section;

(g) sliding a first section of a second curtain rod means through the first lower channel of the semi-circular first side plate and into the lower channel of the semi-circular front plate;

(h) sliding a second section of the second curtain rod means through the second lower channel of the semi-circular second side plate and into the lower channel of the semi-circular front plate;

(i) continuing to slide the first section and the second section of the second curtain rod means while in the lower channel of the semi-circular front plate until the first section of said curtain rod means slides into the second section of said second curtain rod means such that the first section is slidably disposed within said second section;

(j) forming a fabric means into a cylindrical hollow shape;

(k) sliding the formed cylindrical hollow fabric means of step (j) over the first side plate, the front plate and the second side plate such as to entirely surround the semi-circular plate, the first semi-circular side plate and the second semi-circular side plate including the sections of the upper and lower curtain rod means that are slidably disposed in said upper and lower channels respectively of said front plate and in said first upper channel and said first lower channel respectively of said first side plate and in said second upper channel and said second lower channel respectively of said second side plate; and (l) mounting the first and second curtain rod means to a wall member.

It is therefore an object of the present invention to provide a window cornice.

It is another object of the present invention to provide a method for hanging curtains which employs the use of the window cornice.

These, together with the various ancillary objects and features which will become apparent to those skilled in the art as the following description proceeds, are attained by this novel window cornice and method, a preferred embodiment being shown with reference to the accompanying drawings, by way of example only, wherein:

BRIEF DESCRIPTION OF THE DRAWINGS

FIG. 7 is a perspective view of a hollow cylindrical fabric;

FIG. 8 is a partial perspective view of the fabric of FIG. 7 disclosing the seam within the fabric;

FIG. 9 is a vertical sectional view taken in direction of the arrows and along the plane of line 9—9 in FIG. 5;

FIG. 10 is a partial side elevational view of one section of a curtain rod mating with and slidably passing into another section of the curtain rod;

FIG. 11 is a perspective view of the front plate member;

FIG. 12 is a front plan view of the three curtain rods that are employed with the window cornice-curtain assembly of this invention;

FIG. 13 is a partial perspective view of a hollow end of a section of a curtain rod;

FIG. 14 is a perspective view of the hollow cylindrical fabric passing over an end of a pair of curtain rods having secured thereto the front plate member and the pair of side plate members; and FIG. 15 is a partial vertical sectional view taken in direction of the arrows and along the plane of line 15—15 in FIG. 1.

DETAILED DESCRIPTION OF THE INVENTION

Figure 1:
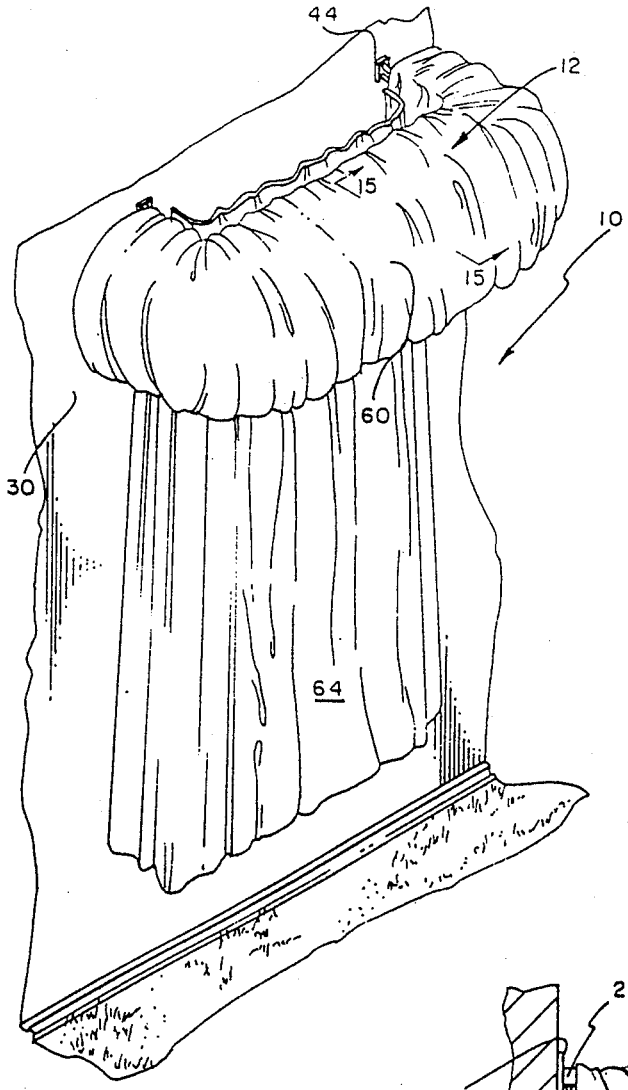
FIG. 1 is a perspective view of the window cornice-curtain assembly.
Figure 2:
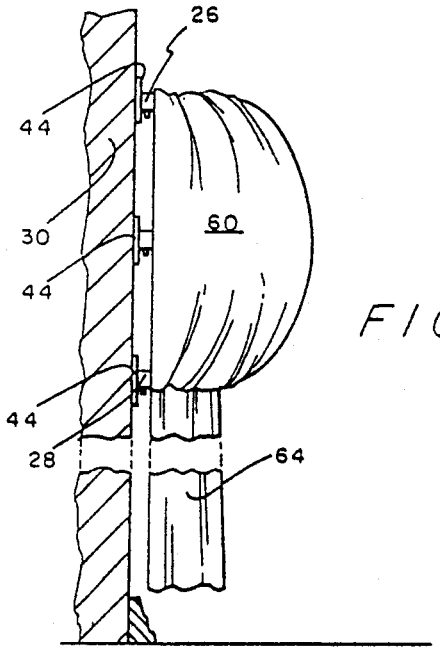
FIG. 2 is a partial segmented side elevational view of the window cornice-curtain assembly of FIG. 1.

Referring in detail now to the drawings wherein similar parts of the invention are identified by like reference numerals, there is seen a window cornice-curtain assembly (see FIG. 1), generally illustrated as 10, comprising a window cornice, generally illustrated as 12, and a curtain assembly, generally illustrated as 14.

Figure 3:
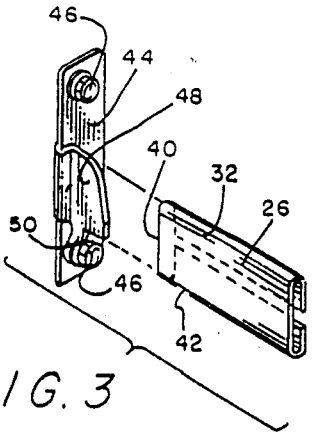
FIG. 3 is a partial perspective view of an end of a section of a curtain rod and a bracket.

The window cornice 12 comprises an arcuate or semi-circular front plate 16 formed with an upper edge means 18 having an upper channel 20, and a lower edge means 22 having a lower channel 24. An upper curtain rod 26 is slidably disposed through the upper channel 20 and a lower curtain rod 28 is slidably disposed through the lower channel 24. The curtain rods 26 and 28 mount to a wall 30, and are conventional curtain rods typically comprising a pair of sections. More specifically and by way of example only in referring to FIG. 10, upper curtain rod 26 comprises sections 32 and 34, with section 32 slidably disposed in section 34. Similarly, lower curtain rod 28 typically comprises a section 36 slidably disposed in a section 38. Each of the sections 32, 34, 36 and 38 have an open end with a lower aperture in close proximity to the open end such that the sections can engage a bracket. Referring to FIG. 3 by way of example only for more specificity, section 32 terminates in a hollow end 40 having a lower aperture 42 in close proximity thereto for mounting to a bracket 44 attached to the wall 30 by bolts 46—46. The bracket 44 includes an ear 48 protruding therefrom and having a lug 50 extending from the lower part thereof. The ear 48 slidably passes into the hollow end 40 such that lug 50 is removably disposed in lower aperture 42. The other sections 34, 36 and 38 are similarly formed such that each may mount to a bracket 44 mounted or attached on the wall 30 in order to hold the semi-circular plate 16 in a general horizontal (or other desired) position.

Figure 4:
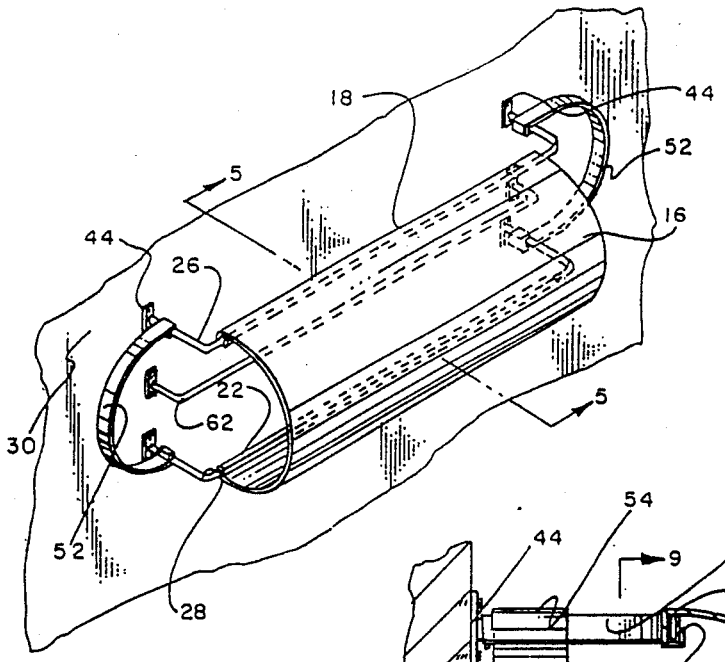
FIG. 4 is a perspective view of the window cornice without the fabric.
Figure 5:
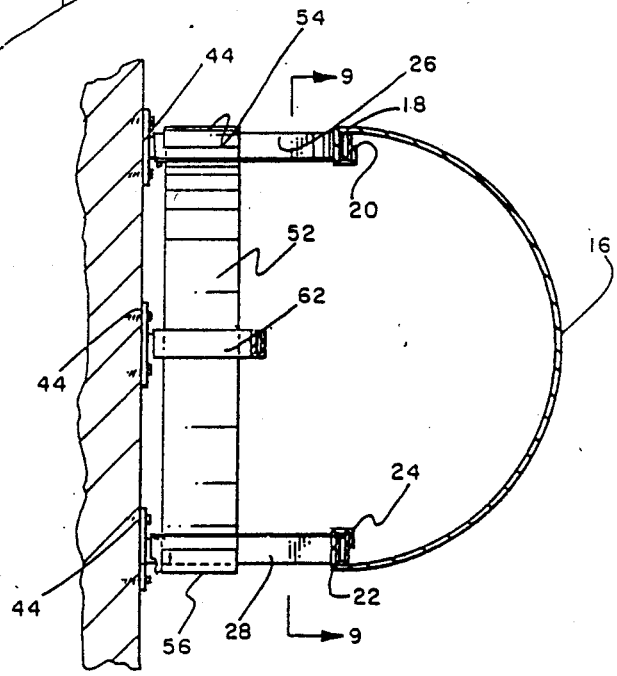
FIG. 5 is a vertical sectional view taken in direction of the arrows and along the plane of line 5—5 in FIG. 4.
Figure 6:
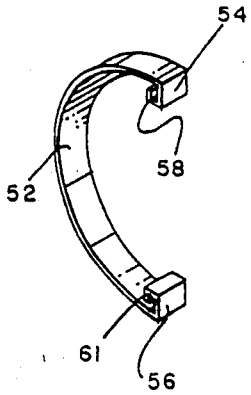
FIG. 6 is a perspective view of a side plate member.

The window cornice 12 may additionally comprise a pair of arcuate or semi-circular side plates 52—52 respectively mounted to the rods 26 and 28 in an opposed relationship as shown in FIG. 4. Each side plate 52 is formed with an upper edge means 54 and a lower edge means 56. The upper edge means 54 and the lower edge means 56 include an upper side channel 58 and a lower side channel 61 respectively (see FIG. 6). Channel 58 slidably receives section 32 or 34 of the rod means 26 and channel 61 slidably receives section 36 or 38 of the rod means 28.

The window cornice 12 additionally includes a fabric 60 formed with a seam 62 and into a hollow cylindrical configuration, as illustrated in FIG. 7. The fabric 60 defines the outside or exterior of the window cornice 12. As illustrated in FIGS. 14 and 15, the combinations of the pair of side plates 52—52, the front plate 16, and the pair of curtain rod means 26 and 28 are surrounded by the fabric 60 by sliding the combinations through the hollow, cylindrical fabric 60. The ends of sections 32, 34, 36 and 38 are left exposed, protruding from the open ends of the cylindrical fabric 60 in order to respectively connect to four brackets 44 which have been secured to desired locations on the wall 30. A third curtain rod means 62 (see FIG. 12) is mounted to the wall member 30 in between rod means 26 and 28, as further illustrated in FIG. 4. A curtain 64 may be hung from this third curtain rod means 62 to obtain the window cornice-curtain assembly 10.

With continuing reference to the drawings for the method for hanging curtains employing the window cornice 12, the front plate 16 and the pair of side plates 52—52 are all initially formed in accordance with the previously mentioned shapes and features. Section 32 of curtain rod means 26 is slid through the upper channel 58 of one of the side plates 52 and into the upper channel 20 of the front plate 16. Section 34 of curtain rod means 26 is subsequently slid through the upper channel 58 of the other side plate 52 and into the upper channel 20 of the front plate 16. Sections 32 and 34 are continually slid while in upper channels 58 and 58 of the two side plates 52—52 respectively and while in the upper channel 20 of the front plate 16 until the section 32 slides into the section 34 (see FIG. 9). Similarly, section 36 of curtain rod means 28 is slid through the lower channel 61 of the side plate 52 having section 32 in its upper channel 58, and into the lower channel 24 of the front plate 16. Section 38 of rod means 28 is subsequently slid through the lower channel 61 of side plate 52 having section 34 in its upper channel 58, and into the lower channel 24 of the front plate 16. Sections 36 and 38 are continually slid while in the lower channels 61 and 61 of side plates 52—52 respectively and while in the lower channel 24 of the front plate 16 until section 36 slides into section 38 (see FIG. 9). Thereafter, fabric 60 is formed into the hollow cylindrical shape of FIG. 7, and as illustrated in FIG. 14, the formed hollow cylindrical fabric 60 is slid over one of the side plates 52, the front plate 16, and the other side plate 52 such as to entirely surround all of the same including the respective sections of the curtain rod means 26 and 28 in the upper and lower channels respectively of the front plate 16 and the pair of side plates 52—52. The hollow ends 40 of sections 32, 34, 36 and 38 are exposed in order to engage four brackets 44—44—44—44 which have been disposed as desired on the wall 30. The third curtain rod means 62 may now be mounted to a pair of brackets 44—44 that have been respectively positioned between the two pairs of outside brackets 44—44 and 44—44 such that rod means 62 is in between the rod means 26 and 28. The curtain 64 can now be hung from the third curtain rod means 62 to produce the window cornice-curtain assembly 10 of FIG. 1. It is to be understood as would be readily apparent that the third curtain rod means 62-curtain 64 combination can be secured to wall 30 initially, followed by the mounting of the window cornice 12 such as to cover the top of the curtain 64 including the third curtain rod means 62.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for hanging curtains and the like comprising the steps of:

(a) forming a generally semi-circular front plate having an upper edge defining an upper channel and a lower edge defining a lower channel;

(b) forming a generally semi-circular first side plate member having a first upper edge defining a first upper channel and a first lower edge defining a first lower channel;

(c) forming a generally semi-circular second side plate member having a second upper edge defining a second upper channel and a second lower edge defining a second lower channel;

(d) sliding a first section of a first curtain rod means through the first upper channel of the semi-circular first side plate and into the upper channel of the semi-circular front plate;

(e) sliding a second section of the first curtain rod means through the second upper channel of the semi-circular second side plate and into the upper channel of the semi-circular front plate;

(f) continuing to slide the first section and the second section of the first curtain rod means while in the upper channel of the semi-circular front plate until the first section slides into the second section such that the first section is slidably disposed within said second section;

(g) sliding a first section of a second curtain rod means through the first lower channel of the semi-circular first side plate and into the lower channel of the semi-circular front plate;

(h) sliding a second section of the second curtain rod means through the second lower channel of the semi-circular second side plate and into the lower channel of the semi-circular front plate;

(i) continuing to slide the first section and the second section of the second curtain rod means while in the lower channel of the semi-circular front plate until the first section of said curtain rod means slides into the second section of said second curtain rod means such that the first section is slidably disposed within said second section;

(j) forming a fabric means into a cylindrical hollow shape;

(k) sliding the formed cylindrical hollow fabric means of step (j) over the first side plate, the front plate and the second side plate such as to entirely surround the semi-circular plate, the first semi-circular side plate and the second semicircular side plate including the sections of the upper and lower curtain rod means that are slidably disposed in said upper and lower channels respectively of said front plate and in said first upper channel and said first lower channel respectively of said first side plate and in said second upper channel and said second lower channel respectively of said second side plate; and (l) mounting the first and second curtain rod means to a wall member.

2. The method of claim 1 additionally comprising mounting a third curtain rod means to the wall member in between the first and second curtain rod means.

3. The method of claim 2 additionally comprising mounting a curtain means to said third rod means such that said curtain means hangs below said fabric means of step (k).

* * * * *